US005481052A

United States Patent [19]

Hardman et al.

[11] Patent Number: 5,481,052

[45] Date of Patent: Jan. 2, 1996

[54] POLYMER CRACKING

[75] Inventors: Stephen Hardman, Herts, England; Stephen A. Leng, West Lothian; David C. Wilson, Stirling, both of Scotland

[73] Assignee: BP Chemicals Limited, London, England

[21] Appl. No.: 44,646

[22] Filed: Apr. 8, 1993

[30] Foreign Application Priority Data

Apr. 22, 1992 [GB] United Kingdom ..... 9208729
Apr. 23, 1992 [GB] United Kingdom ..... 9208794

[51] Int. Cl.[6] ..... C07C 1/08; C07C 4/00

[52] U.S. Cl. ..... 585/241; 585/648; 585/653; 208/49; 208/50; 208/51; 208/52 R; 208/59; 208/60; 208/61; 208/67; 208/68; 208/69; 208/70; 208/72; 208/106; 208/107; 208/108

[58] Field of Search ..... 585/10, 241, 648, 585/653; 208/49, 50, 51, 52 R, 59, 60, 61, 67, 68, 69, 70, 72, 106, 107, 108

[56] References Cited

U.S. PATENT DOCUMENTS

| | | | |
|---|---|---|---|
| 3,901,951 | 8/1975 | Nishizaki . | |
| 4,147,593 | 4/1979 | Frischmuth . | |
| 4,151,216 | 4/1979 | Smith | 585/241 |
| 4,740,270 | 4/1988 | Roy | 585/241 |
| 4,822,573 | 4/1989 | Timmann . | |
| 4,851,601 | 7/1989 | Fukuda et al. | 585/241 |
| 5,136,117 | 8/1992 | Paisley et al. | 585/241 |
| 5,364,995 | 11/1994 | Kirkwood et al. | 585/241 |

FOREIGN PATENT DOCUMENTS

| | | |
|---|---|---|
| 832539 | 2/1976 | Belgium . |
| 2415412 | 10/1974 | Germany . |
| 228418 | 10/1985 | Germany . |
| 3819699 | 6/1988 | Germany . |
| 257639 | 6/1988 | Germany . |
| 48-000967 | 9/0973 | Japan . |
| 52-014601 | 3/1977 | Japan . |
| 1397422 | 5/1988 | U.S.S.R. . |
| 9113948 | 9/1991 | WIPO . |
| 9204423 | 3/1992 | WIPO . |
| 93/07105 | 4/1993 | WIPO . |

*Primary Examiner*—Anthony McFarlane
*Assistant Examiner*—E. D. Irzinski
*Attorney, Agent, or Firm*—Brooks Haidt Haffner & Delahunty

[57] ABSTRACT

This invention relates to a process for cracking waste polymers in a fluidized bed reactor to produce vaporous products comprising primary products which can be further processed, eg in a steam cracker to produce olefins, characterized in that the vaporous products are treated to generate a primary product substantially free of a high molecular weight tail having molecular weights >700 prior to further processing. The removal of the high molecular weight tail minimizes fouling and prolongs the lifetime of the reactors used for further processing.

7 Claims, No Drawings

POLYMER CRACKING

The present invention relates to a process for cracking polymers, especially olefin polymers, whether virgin or waste, in order to produce lower hydrocarbons so as to conserve valuable resources.

It is well known in the art to process polymers to form lower hydrocarbons such as paraffins, olefins, naphtha or waxes by cracking the polymer in a fluidised bed at elevated temperatures. The product of such a process can be further cracked in a steam cracker to form low olefins or paraffins. In the case where the polymer is cracked with a view to subsequent further processing, such a process can produce a product (hereafter "primary product") with a high molecular weight tail (hereafter "HMWT") if the process is not controlled adequately. HMWT in the process stream can cause considerable problems, especially if the primary product with its HMWT content is fed directly into a steam cracker during further processing. On the other hand, if the HMWT formation is minimised, this will enable control not only of the molecular weight of the product formed but also of the rheology of the primary product and mixtures thereof with naphtha thereby enabling the use of a wide range of existing crackers/plants and obviating the need for designing specific/new equipment and reducing the risk of potential shutdowns of part or the whole of the process/plant.

The reduction of the HMWT will lower the temperature at which a particular mixture of the primary products with other solvents will be a liquid. Significant reduction can lead to primary products that are liquids at room temperature in the absence of solvents. This has considerable advantages in transportation and handling even if the final cracking unit can tolerate larger amounts of HMWT. This would apply e.g. in fluidised catalytic crackers (FCC).

The molecular weight of such a product is conventionally controlled by eg fractionation/distillation of the product. Such a remedy however creates further waste products which need further processing steps thereby rendering the process economically and environmentally less attractive.

Prior art processes are known to minimise the formation of HMWT during polymer cracking. However, such processes either generate unwanted aromatics (eg >20% w/w) or produce excessive amounts of gas (eg >40% w/w) which can only be used as a fuel or burnt and result in loss of valuable chemical raw materials. One such process is described by Kaminsky, W et al in "Conservation and Recycling", Vol 1, pp 91–110 where the polymers are cracked in a fluidised bed at elevated temperatures above 650° C.

In another process, (cf. SU-A-1397422) the cracking step is carried out in the presence of cadmium and indium oxides. However, the latter process produces a large quantity of gaseous by-products thereby resulting in loss of valuable chemical raw materials.

It is well known that in order to minimise fouling and to prolong the lifetime of reactors used for further processing of the products from polymer cracking, eg steam cracker reaction tubes, it is essential to vaporise the feed before the cross-over point into the radiant section (eg 450°–600° C.). Otherwise excessive coking occurs which requires expensive cleaning downtime and the lifetime of the cracking tubes is reduced.

Moreover, it is desirable that such steam crackers are fed with products that closely match the specification for which they were constructed. Therefore, it is desirable that the product from the polymer cracking stage (primary product) matches the top specification of typical chemical naphtha eg final boiling point of 300° C.

Accordingly, the present invention is a process for cracking a polymer in a fluidised bed reactor into vaporous products comprising primary products capable of being further processed characterized in that the vaporous products are treated to generate a primary product substantially free of a high molecular weight tail (hereinafter HMWT) comprising hydrocarbons having a molecular weight of at least 700 as measured by gel permeation chromatography.

By the expression "polymer" is meant here and throughout the specification virgin (scrap generated during processing of the plastics into the desired article) or waste after the plastics has performed its desired function. The term "polymer" therefore includes polyolefins such as polyethylene, polypropylene and EPDM with or without one or more of other plastics eg polystyrene, polyvinyl halides such as PVC, polyvinylidene halides, polyethers, polyesters and scrap rubber. In addition, the polymer stream may contain small amounts of labelling, closure systems and residual contents.

The fluidised bed used is suitably comprised of solid particulate fluidisable material which is suitably one or more of quartz sand, silica, ceramics, carbon black, refractory oxides such as eg zirconia and calcium oxide. The fluidising gas is suitably chosen so that it does not oxidise the hydrocarbons produced. Examples of such a gas are nitrogen, the recycled gaseous products of the reaction or refinery fuel gas. The recycled gaseous products used are suitably components of the vaporous products emerging from the fluidised bed which are separated using a flash or other suitable liquid-gas separation unit at a set temperature −50° to 100° C. Refinery fuel gas referred to above is a mixture comprising hydrogen and aliphatic hydrocarbons, principally $C_1$ to $C_6$ hydrocarbons. The fluidising gas may contain carbon dioxide over a wide range of concentrations. The fluidisable material suitably comprises particles of a size capable of being fluidised, for example 100 to 2000 μm.

The heat for the reaction is suitably brought in by the fluidising gas. The polymer to fluidising gas weight ratio is suitably in the range from 1:1 to 1:20, preferably 1:3 to 1:10. The polymer can be added to the fluidised bed either as a solid or in the form of a melt but is preferably added in the solid form. The fluidised bed may contain materials to absorb acidic gases or other contaminants in the polymer feed.

By the expression "vaporous products" is meant here and throughout the specification products comprising saturated and unsaturated aliphatic and aromatic hydrocarbons, and containing less than 25% w/w, preferably less than 20% w/w of gases comprising $C_1$–$C_4$ hydrocarbons, hydrogen and other carbonaceous gases; and containing no more than 10% w/w of aromatic hydrocarbons associated with the weight of polyolefin polymers in the feed.

The vaporous products include the "primary products" which are the products which separate as solids and/or liquids from the vaporous products emerging from the fluidised bed polymer cracking reactor when that reactor is cooled to temperatures around ambient (eg −5° to +50° C.)□ By the expression "a high molecular weight tail" (hereafter "HMWT)" is meant here and throughout the specification a product which comprises hydrocarbons having a molecular weight (Mw) of at least 700 as measured by gel peremeation chromatography (GPC). A molecular weight of 700 represents molecules having about 50 carbon atoms.

A feature of the present invention is that the proportion of the polymer which is low conversion of the polymer into vaporous products having less than 4 carbon atoms and the substantial absence of aromatic hydrocarbons.

The following method was used for the GPC analysis/test:

A smear of a sample was made up in a 4 ml vial with trichlorobenzene at about 0.01% w/w concentration. This was then held in an oven at 140° C. for 1 hr. This sample was then run on GPC. The trichlorobenzene was used as the solvent to carry the sample through the columns of the GPC for analysis using the following apparatus:

Using Walters model 150 CV chromatograph with three 30 cm Walters columns in series namely AT 807M (107 Angstroms); AT 80M (Mixed column); AT 804M (104 Angstroms) respectively. The instrument was calibrated using standards from Polymer Laboratores Ltd.: 2000, 1000, 700 MW linear polyethylenes and linear hydrocarbons $C_{36}H_{74}$ MW 506.99; $C_{22}H_{46}$ MW 310.61; $C_{16}H_{34}$ MW 226.45. Results are shown in Table 1 in which $M_N$=arithmetic mean molecular weight $$= \sum_{i=1}^{n} (N_i M_i)$$

$M_W$=Mean mass molecular weight $$= \sum_{i=1}^{n} (x_i M_i)$$

wherein $x_i$=mass fraction of given increment, n=number of increments,

Mi=average molecular weight in increment i, $N_T$=number of molecules in total sample, $N_i$=number of molecules in increment.

Typical figures for the HDPE $M_N$=11000 and $M_W$=171000.

The results obtained by using the above method and calculations are tabulated below in each of the Examples.

By the expression "steam cracker" is meant here and throughout the specification conventional steam crackers used for cracking hydrocarbons, waxes and gas oils for producing olefins and comprising a preliminary convective section and a subsequent radiant section, the cracking primarily occurring in the radiant section and the cross-over temperature between the convective section and the radiant section of the cracker suitably being in the range from 400°–750° C., preferably from 450 °–600° C.

By the expression "substantially free of a high molecular weight tail" is meant here and throughout the specification that the primary products fed eg to the convection section of a steam cracker □ contain no more than 15% w/w of the HMWT, suitably less than 10% w/w, preferably less than 5% w/w of HMWT in the total primary products fed. The amount of HMWT in the primary products from the fluidised bed polymer cracking step can be minimised in various ways. For instance, one or more of the following methods can be used:

1) The vaporous products leaving the fluidised bed may be fractionated either in situ or externally to separate the HMWT content thereof and the treated HMWT fraction can be returned to the fluidised bed for further cracking.
2) The fluidised bed reactor can be operated under pressure in order to maximise the residence time of any large molecules eg HMWT in the reactor thereby enabling these larger molecules to be cracked to smaller molecules. The pressure used is suitably in the range from 0.1–20 bar gauge, preferably from 2–10 bar gauge. The use of pressure in the fluidised bed can also enable control of volume flow through the reactor thereby allowing enhanced residence time for the polymer and the cracked products in the fluidised bed thereby reducing the HMWT in situ.
3) A catalytic fluidised bed can be used to reduce HMWT in situ. The entire particulate solid used as the fluidised bed may be an acidic catalyst although the acidic catalytic component is suitably less than 40% w/w of the total solids in the fluidised bed, preferably less than 20% w/w, more preferably less than 10% w/w. The following are examples of catalyst groups that may be suitably used in this process: cracking catalysts; catalysts having inherent acidity, eg alumina; silica; alumina-silicas; zeolites; fluorinated compounds; pillared clays; zirconium phosphates; and combinations thereof.

The fluidised bed is suitably operated at a temperature from 300°–600° C. preferably at a temperature from 450°–550° C.

The primary products free of the HMWT can be further processed to other hydrocarbon streams in units designed to upgrade the value of products derived from crude oil. Such units are normally found at an oil refinery and include, in addition to steam crackers, catalytic crackers, vis-breakers, hydro-crackers, cokers, hydro-treaters, catalytic reformers, lubricant base manufacturing units and distillation units.

The present invention is further illustrated with reference to the following Examples. Gel Permeation Chromatography (GPC) analysis of the samples, where stated for the collected primary products in the Examples, were carried out as described above and the results are shown below under the appropriate Examples.

EXAMPLES & COMPARATIVE TESTS

Comparative Tests 1–8 (Not According to the Invention):

These illustrate that the adjustment of temperature alone cannot be used to produce the desired combination of low HMWT and low gas production.

A fluidised quartz sand bed reactor fluidised with nitrogen was used to crack polyethylene (HDPE 5502XA ex BP Chemicals Ltd) except in (i) CT 3 where the polymer used was a mixture of 90% HDPE and 10% PVC and (ii) CT 8 where the polymer used was a mixture of 70% HDPE, 15% polystyrene, 10% PVC and 5% polyethylene terephthalate.

80 g of quartz sand (180–250 μm size) (about 50 ml in the unfluidised state) was fluidised in a 45 mm outside diameter quartz tube fluid bed reactor. The reactor was provided with a three zone tubular furnace for heating to the required temperature (400°–600° C.), the first zone being used to pre-heat the fluidising gas. Nitrogen was used as the fluidising gas at 1.5 liter/min (measured under laboratory conditions). The bed was operated at atmospheric pressure.

Polymer pellets (size typical of pellets used as feed for plastics processing) were fed into the bed with a screw feed at the approx. rate of 50 g/h.

Gaseous products first passed down a section kept at 80°–120° where the majority of the product was collected. The gases passed down an air cooled section after which they were sampled. When a full mass balance was required, all the gases were trapped in bags at the end of the apparatus.

| CT No | Temp of bed (°C.) | % Primary Product >500 MW | >700 MW | $M_W$ | $M_N$ | Gas (<C4) wt % |
|---|---|---|---|---|---|---|
| 1 | 455 | 45.51 | 19.56 | 509 | 400 | 0.9 |
| 2 | 480 | 48.49 | 23.82 | 528 | 386 | 1.86 |
| 3 | 510 | — | 33.4 | 580 | 386 | |
| 4 | 525 | — | 33.2 | 590 | 406 | 7.28 |
| 5 | 530 | 44.67 | 21.09 | 507 | 367 | 4.63 |
| 6 | 530 | 43.70 | 22.09 | 501 | 336 | — |
| 7 | 580 | 29.75 | 14.35 | 410 | 250 | 22.58 |
| 8 | 510 | 56.61 | 34.7 | 607 | 421 | — |

CT — Comparative Test.

The non-gaseous product from these experiments was a wax which melts at about 80° C. A 20% mixture of the 480° C. run (CT 2) is a typical Naphtha (see analysis below) and gives a thick slurry at room temperature that clears at 70° C.

Analysis of naphtha

Aliphatic hydrocarbons

| | | |
|---|---|---|
| $C_4$ | 5.53 | |
| $C_5$ | 31.74 | |
| $C_6$ | 42.13 | |
| $C_7$ | 15.45 | |
| $C_8$ | 0.6 | |
| Aromatic $C_{6-8}$ | 2.82 | |
| Normals 37.35% | ISOs 33.47% | Naph 26.26% |

The primary product from a previous run at 480° C. was analysed by NMR and showed no evidence of aromatics.

EXAMPLE 1

To illustrate the value of increasing the time that the HMWT is held in the reactor zone and thus the potential for fractionation and returning of the heavier product to the feed (cf page 5 paragraph (1) above), the following experiment was performed.

The wax from CT 6 was melted and fed into the reactor set as for CT 1–8 above.

| | Temp of bed (°C.) | % Primary Product >500 MW | >700 MW | $M_W$ | $M_N$ |
|---|---|---|---|---|---|
| CT 6 | 530 | 43.70 | 22.09 | 501 | 336 |
| Ex 1 | 530 | 31.89 | 13.19 | 427 | 298 |

EXAMPLES 2–12

To illustrate the value of catalysts to this process the conditions in CT 1–8 were modified by replacing 8 g of the sand with 8 g catalyst sieved to a suitable size to be compatible with the fluidisation in the bed. This gave a 10% by weight mixture of sand and catalyst. For Examples 2, 8, 10 and 12 the collection system was modified with an 50 mm diameter Aldershaw distillation column with 10 trays filled and topped up with water. This replaced the section at 80° to 120° C. and the air condenser. The polymer fed to the fluidised bed was polyethylene (grade HDPE 5502XA, ex BP Chemicals Ltd) except in Example 3 which used the same polymer as in CT 3; in Example 4 which used the same polymer as in CT 8; and Example 6 in which a mixture by weight of polyethylene (97% grade HDPE 5502XA) and titanium dioxide (3%) was used.

| Example No | Catalyst |
|---|---|
| 2–6 | Gamma Alumina UOP SAB-2 |
| 7 | Zeolite/Alumina Advanced 507A (ex AKZO) C154 |
| 8 | " |
| 9 | " |
| 10 | " |
| 11 | Alumina Matrix (BP2906 sample ex Katalystics) |
| 12 | Alumina Matrix (BP2906 sample ex Katalystics) |

| Ex No | Temp of bed (°C.) | % Primary Product >500 MW | >700 MW | $M_W$ | $M_N$ | Gas (<C4) wt % |
|---|---|---|---|---|---|---|
| 2 | 470 | — | 15.20 | 437 | 298 | 2.97 |
| 3 | 510 | — | 4.4 | 270 | 168 | — |
| 4 | 510 | — | 7.1 | 347 | 248 | — |
| 5 | 510 | — | 8.4 | 361 | 242 | — |
| 6 | 510 | 15.3 | 3.5 | — | — | — |
| 7 | 530 | 10.5 | 3.10 | 252 | 157 | — |
| 8 | 510 | — | — | — | — | 9.93 |
| 9 | 480 | — | 2.03 | 186 | 95 | 15.1 |
| 10 | 430 | — | — | — | — | 4.8 |
| 11 | 480 | 6.8 | 1.80 | 214 | 130 | 5.6 |
| 12 | 480 | — | — | — | — | 5.1 |

The product from Example 9 was analysed by a slightly different GPC technique.

The non-gaseous product from these experiments ranged from a soft wax to a near clear liquid. Example 2 gave a soft wax which melts at about 70° C. A 20% mixture of this in naphtha as above gives a thin cream at room temperature that clears at 60° C. Example 9 gave a cloudy liquid at room temperature which settled with time to give a clear top section and some wax present in the lower half. A 20% mixture of this in naphtha as above gives a slightly hazy solution at room temperature that clears fully at 50° C. Example 10 gave a hazy liquid at room temperature. A 20% mixture of this in naphtha as above gives a clear solution at room temperature.

Primary products from Examples 7 and 9 were analysed by NMR which show no evidence of aromatics.

EXAMPLE 13

To illustrate the performance in the steam cracking stage of the product produced with a catalyst in the bed, the product of Example 12 was mixed 50/50 with naphtha and passed through a micro-cracker at 800° C. at 20 psig using a feed rate of 2.0 ml/hr and a helium flow rate of 6.0 liters/hr at NTP.

The product of this cracking operation was analysed and compared to the result from the neat naphtha.

| Chemical | 100% Naphtha 0% Ex 12 | 50% Naphtha 50% Ex 12 | By calculation 100% Ex 12 |
|---|---|---|---|
| Hydrogen | 1.2 | 0.8 | 0.4 |
| Methane | 13.3 | 13.2 | 13.1 |
| Ethane | 2.6 | 2.4 | 2.2 |
| Ethylene | 26.0 | 24.6 | 23.2 |
| Acetylene | 0.2 | 0.2 | 0.2 |
| Propane | 0.3 | 0.6 | 0.9 |
| Propylene | 18.8 | 15.9 | 13.0 |

-continued

| Chemical | 100% Naphtha 0% Ex 12 | 50% Naphtha 50% Ex 12 | By calculation 100% Ex 12 |
|---|---|---|---|
| $C_3$ Acetylenes | 0.3 | 0.3 | 0.3 |
| Isobutane | 0.0 | 0.0 | 0.0 |
| n-Butane | 0.6 | 0.2 | −0.2 |
| Butene-1 | 0.2 | 1.5 | 0.8 |
| Isobutene | 2.9 | 2.6 | 2.3 |
| Butene-2 | 1.1 | 0.8 | 0.5 |
| Butadiene | 4.9 | 5.1 | 5.3 |
| Isopentane | 2.2 | 0.9 | −0.4 |
| n-Pentane | 3.8 | 1.7 | −0.4 |
| Gasoline + Fuel Oil | 19.6 | 29.2 | 38.8 |

EXAMPLE 14

To illustrate the effect of pressure, a fluid bed reactor of 78 mm diameter was charged with Redhill 65 sand (ex Hepworth Minerals and Chemicals Ltd) and fluidised using nitrogen at a flow rate of 15 l/minute (@ NTP) and heated to a temperature of about 530° to 540° C. Polyethylene (HDPE 5502XA ex BP Chemicals Ltd) was charged at about 200 g/hour. This reactor had much shorter residence time than the reactor described in CT 1 and thus gave higher Molecular weight tail for the same operating conditions of pressure and temperature—Mw for this apparatus at 530° C. and 1 bar gauge is predicted to be 900 (cf CT 6 at 501). The heavy molecular weight tail was halved by increasing the pressure from 1 bar gauge to 2 bar gauge (38.3% to 19.1%). These results have been extrapolated using a reliable computer model to a fluid reactor at 550° C. and 3 bar gauge with longer residence time and recycling a portion of the gas from the cracking of the polymer as the fluidising gas to show that no more than 0.04% is HWMT and at 9 bar gauge no more than 0.006% HMWT. The data for tail above a molecular weight of 500 are 0.5% and 0.06% respectively. The data for tail above a molecular weight of 350 is 7.5% and 1.2% respectively.

We claim:

1. A process for cracking a polymer into hydrocarbon products which comprises contacting a polymer with a fluidized bed comprising (i) one or more particulate materials of quartz, sand, silica, ceramics, carbon black, and refractory oxides and (ii) an acidic catalyst in the presence of a fluidizing gas which does not oxidize the hydrocarbon products and at a temperature of 300°–600° C. and under pressure, said hydrocarbon products comprising saturated and unsaturated aliphatic and aromatic hydrocarbons:

a. which have less than 20% w/w of gases comprising C1–C4 hydrocarbons, b. containing no more than 10% w/w of aromatic hydrocarbons associated with the weight of polyolefin polymers in the feed, and c. which are substantially free of a high molecular weight tail comprising hydrocarbons having a molecular weight of at least 700 as measured by GPC, the amount of high molecular weight tail product being minimized by fractionating the products to separate product with a high molecular weight tail and recycling said high molecular weight tail product back to the fluidized bed for re-cracking.

2. A process for cracking a polymer into hydrocarbon products which comprises contacting a polymer with a fluidized bed comprising one or more particulate materials of quartz, sand, silica, ceramics, carbon black, and refractory oxides in the presence of a fluidizing gas which does not oxidize the hydrocarbon products comprising saturated and unsaturated aliphatic and aromatic hydrocarbons:

a. Which have less than 20% w/w of gases comprising C1–C4 hydrocarbons, b. containing no more than 10% w/w of aromatic hydrocarbons associated with the weight of polyolefin polymers in the feed, and c. which are substantially free of a high molecular weight tail comprising hydrocarbons having a molecular weight of at least 700 as measured by GPC, the amount of high molecular weight tail product being minimised by fractionating the products to separate the high molecular weight tail product and recycling said high molecular weight tail product back to the fluidized bed for re-cracking.

3. A process according to claim 1 or claim 2 wherein the hydrocarbon products are mixed with naptha and steam cracked to produce a product stream comprising ethylene.

4. A process according to claim 1 or claim 2 wherein the fluidising gas comprises at least one component of the products from the fluidised bed reactor which is recycled.

5. A process according to claim 1 or claim 2 wherein the fluidised bed reactor is operated at a temperature from 300°–600° C.

6. A process according to claim 1 or claim 2 wherein the weight ratio of polymer to the fluidising gas is in the range from 1:1 to 1:20.

7. A process according to claim 1 wherein the catalytic component of the fluidised bed is less than 40% wt of the total solids in the fluidised bed.

* * * * *